US007273993B1

(12) United States Patent
Tanner et al.

(10) Patent No.: US 7,273,993 B1
(45) Date of Patent: Sep. 25, 2007

(54) KEYPAD FOR DATA ENTRY

(75) Inventors: James L. Tanner, Grayslake, IL (US); Ralph G. Cory, Wauconda, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/385,566

(22) Filed: Mar. 21, 2006

(51) Int. Cl.
*H01H 9/00* (2006.01)

(52) U.S. Cl. ..... 200/314; 200/341

(58) Field of Classification Search ..... 200/5 R, 200/5 A, 17 R, 18, 4, 1 R, 341, 520, 512–517, 200/405, 406, 16 R–16 D
See application file for complete search history.

(56) References Cited

U.S. PATENT DOCUMENTS 5,828,016 A * 10/1998 Grannan et al. ..... 200/16 R
6,965,196 B2 * 11/2005 Murasko et al. ..... 313/506
6,982,394 B2 * 1/2006 Ide et al. ..... 200/516
2002/0011786 A1 * 1/2002 Murasko et al. ..... 313/518
2006/0011461 A1 * 1/2006 Chan et al. ..... 200/344
2006/0024110 A1 * 2/2006 Dombrowski et al. ..... 400/490
2006/0024111 A1 * 2/2006 Dombrowski et al. ..... 400/490
2006/0037848 A1 * 2/2006 Kobayashi ..... 200/310
2006/0254894 A1 * 11/2006 Jung et al. ..... 200/314

* cited by examiner

*Primary Examiner*—Elvin Enad
*Assistant Examiner*—Lisa Klaus
(74) *Attorney, Agent, or Firm*—Matthew C. Loppnow; Gary J. Cunningham

(57) ABSTRACT

A keypad (102) for entering data in an electronic device (100) is disclosed. The keypad includes a first carrier (302), a key panel (202), and a backlighting module (204). The key panel is coupled to a first side of the first carrier and the backlighting module is coupled to a second side of the first carrier.

17 Claims, 2 Drawing Sheets

KEYPAD FOR DATA ENTRY

FIELD

The present disclosure relates in general to the field of electronic devices, and more specifically, to keypads for data entry in electronic devices.

BACKGROUND

Presently, electronic devices used for data processing and communication, are made more portable and aesthetic. Examples of electronic devices include mobile phones, computers, laptops, Personal Digital Assistants, palmtops, portable gaming devices, and the like. Electronic devices have been made portable in part by reducing the size of various data input and output devices that are in-built in the electronic devices. Most of the electronic devices use keypads as data input devices. A keypad includes at least a key panel, an actuator panel, and a dome panel that is electrically coupled to a printed circuit board. The keypad further includes a backlighting module for illuminating the key panel. Examples of the backlighting module include, but are not limited to, a Liquid Crystal Display (LCD), a Light Emitting Diode (LED), and an Electroluminescent (EL) panel. The electronic device can be made aesthetic by changing the key panel style or color, the backlighting color, and other aspects of the electronic device.

In existing keypads, the key panel is coupled to a carrier film. The key panel is placed above the actuator panel and the dome panel, which is present below the actuator panel. The backlighting module, such as the EL panel, is coupled to another carrier film and then adhered on the printed circuit board.

However, the existing keypad suffers from the disadvantage of being thick because of the presence of different carrier layers for the key panel and the EL panel. Moreover, due to the presence of the EL panel below the actuator panel and the dome panel, the actuators on the actuator panel and domes on the dome panel will be visible through a clear key panel. Unfortunately, this may be undesirable if aesthetics were to require a clear key panel. Furthermore, changing the key panel and the EL panel require undesirable extensive modifications in the printed circuit board of the keypad because the EL panel is adhered to the printed circuit board.

BRIEF DESCRIPTION OF THE FIGURES

The present disclosure is illustrated by way of example, and not limitation, in the accompanying figures, in which like references indicate similar elements, and in which.

Figure 1:
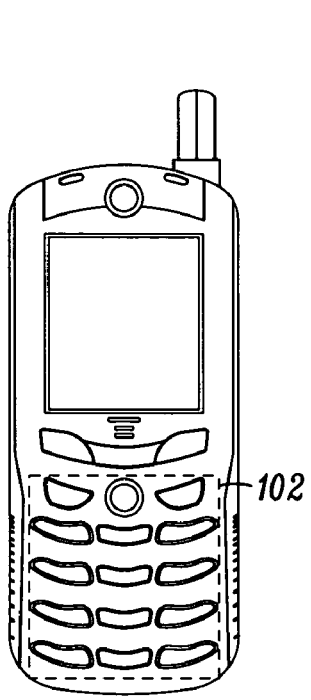
FIG. 1 illustrates an electronic device, in accordance with an embodiment of the present disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION

An embodiment of the present disclosure provides a keypad for entering data in an electronic device. The keypad includes a first carrier, a key panel, and a backlighting module. The key panel is coupled to a first side of the first carrier, and the backlighting module is coupled to a second side of the first carrier.

Before describing in detail the particular keypad for entering data in the electronic device in accordance with the present disclosure, it should be observed that the present disclosure resides primarily in combinations of apparatus components related to the keypad for the electronic device. Accordingly, the apparatus components have been represented where appropriate by conventional symbols in the drawings, showing only those specific details that are pertinent to understanding the present disclosure so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms 'comprises', 'comprising,' or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by 'comprises . . . a' does not, without more constraints, preclude the existence of additional identical elements in the process, method, article, or apparatus that comprises the element.

The term 'another', as used herein, is defined as at least a second or more. The terms 'including' and/or 'having', as used herein, are defined as comprising.

FIG. 1 illustrates an electronic device 100, in accordance with an embodiment of the present disclosure. Examples of the electronic device 100 include, but are not limited to, a mobile phone, a laptop, a Personal Digital Assistant (PDA), and a portable gaming device. The electronic device 100 includes, in addition to other essential components, a keypad 102. The keypad 102 is used for entering data in the electronic device 100.

Figure 2:
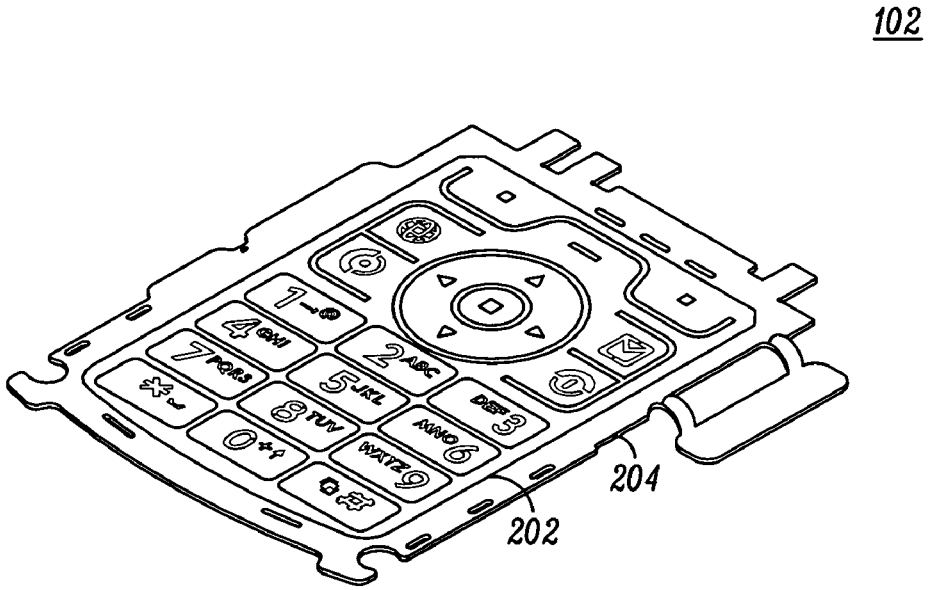
FIG. 2 illustrates a keypad, in accordance with an embodiment of the present disclosure.

FIG. 2 illustrates the keypad 102, in accordance with an embodiment of the present disclosure. The keypad 102 includes a key panel 202 and a backlighting module 204. In one embodiment of the present disclosure, the key panel 202 may be a key top array with an array of keys. In another embodiment of the present disclosure, the key panel 202 may be a sheet with keys separated by depressions between the key tops. In yet another embodiment of the present disclosure, the key panel 202 may be replaceable. The backlighting module 204 is present below the key panel 202. The backlighting module 204 illuminates the key panel 202. Examples of the backlighting module 204 include, but are not limited to, a Liquid Crystal Display (LCD), a Light Emitting Diode (LED), and an Electroluminescent (EL) panel. In an embodiment of the present disclosure, the backlighting module 204 or the keypad 202 can be easily replaced to change the backlight color.

Figure 3:
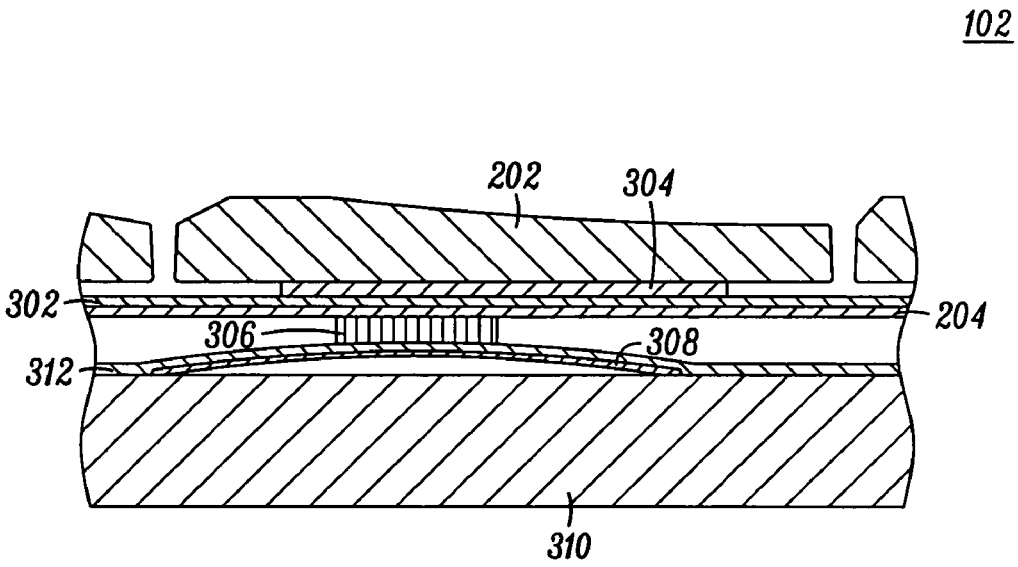
FIG. 3 illustrates a side view of the keypad, in accordance with an embodiment of the present disclosure.

FIG. 3 illustrates a side view of the keypad 102, in accordance with an embodiment of the present disclosure. The keypad 102 includes, in addition to the key panel 202 and the backlighting module 204; a first carrier 302. The key panel 202 is coupled to a first side of the first carrier 302, using an adhesive layer 304. In an embodiment of the present disclosure, the first carrier 302 is a polyethylene terephthalate (PET) substrate, a polyester substrate, a poly carbonate (PC) substrate, any polymer film, or any other carrier useful for coupling a backlighting module to a key panel. In another embodiment of the present disclosure, the first carrier 302 comprises a film and the key panel 202 is coupled to the first side of the first carrier 302 by an adhesive. The backlighting module 204 is coupled to a second side of the first carrier 302. Therefore, the key panel 202 and the backlighting module 204 are coupled only to the first carrier 302 and it is not necessary to couple the backlighting module 204 to a second carrier. The keypad 102 can further include an actuator panel 306, a dome panel 308, and a printed circuit board 310. The actuator panel 306 is located on an opposite side of the backlighting module 204 from the key panel 202 and is operatively coupled to the key panel 202. In an embodiment of the present disclosure, the actuator panel 306 is present below the backlighting module 204. The actuator panel 306 can act as a switching mechanism that can actuate an electrical signal for the electronic device 100 when a key top on the key panel 202 is pressed. The actuator panel 306 can include an array of actuators connected coupled or adhered to the backlight panel 204, to each key top on the key panel 202, to the dome array film 312, or the actuator panel 306 may float between the backlight panel 204 and the dome array film 312. The dome panel 308 can be operatively coupled to the actuator panel 306 through a dome array film 312. The dome panel 308 is present below the actuator panel 306. An example of the dome array film 312 is a Mylar sheet or any polymer film. The dome panel 308 can have an array of metal domes with each metal dome connected to each of the actuators in the actuator panel 306. The printed circuit board 310 can be coupled to the dome panel 308. The printed circuit board 310 can form a circuitry layer for the keypad 102. When a key top is pressed, the actuator panel 306 pushes down the dome panel 308 in such a manner that the metal dome can touch a conductor on the printed circuit board 310. Therefore, an electrical circuit on the printed circuit board 310 can be completed and data, corresponding to the key, is entered in the electronic device 100.

Figure 4:
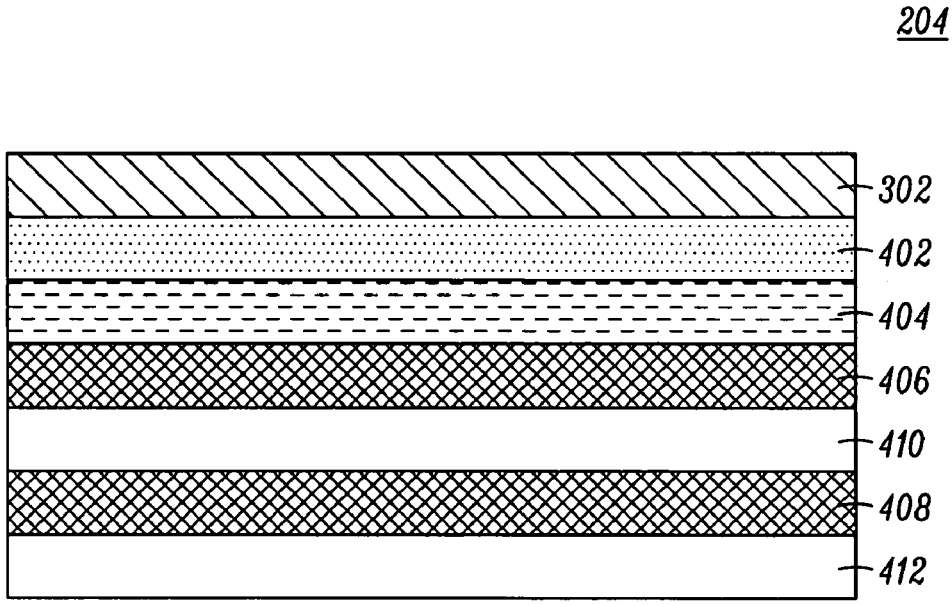
FIG. 4 illustrates a backlighting module used in the keypad, in accordance with an embodiment of the present disclosure.

FIG. 4 illustrates the backlighting module 204, in accordance with an embodiment of the present disclosure. The backlighting module 204, which is coupled to the second side of the first carrier 302, includes a conducting layer 402, a phosphor layer 404, and one or more of electrodes 406 and 408. The conducting layer 402 can be applied on the second side of the first carrier 302 by performing a sputtering process or screen printing process. Examples of the conducting layer 402 include, but are not limited to, an indium tin oxide layer. In an embodiment of the present disclosure, the conducting layer 402 is translucent. The phosphor layer 404 is screen printed on the first carrier 302. The phosphor layer 404 emits light when it is energized by one or more of the electrodes, 406 and 408. The one or more electrodes 406 and 408 may be opaque electrodes. Examples of one or more electrodes include carbon electrodes, silver electrodes, and so forth. The backlighting module 204 can further include one or more insulating layers 410 and 412. The one or more insulating layers 410 and 412 are present between the one or more electrodes 406 and 408. The one or more insulating layers 410 and 412 are made of insulating materials like oxides of aluminum, oxides of titanium, oxides of silicon, and oxides of yttrium. In an embodiment of the present disclosure, the phosphor layer 404, the one or more of the electrodes 406 and 408, and the one or more of the insulating layers 410 and 412 are screen printed on the first carrier 302.

In accordance with another embodiment of the present disclosure, the keypad includes an Electroluminescent (EL) panel having a first side and a second side, a key panel, and a dome array. The key panel is coupled to the first side of the EL panel by an adhesive. The dome array is coupled to the second side of the EL panel. The dome array includes an actuator panel coupled to the second side of the EL panel and a dome panel coupled to the actuator panel. The actuator panel is operatively coupled to the key panel. The dome panel lies below the actuator panel. The keypad further includes a printed circuit board coupled to an opposite side of the dome array from the EL panel.

The EL panel includes a conducting layer, a phosphor layer, and one or more electrodes. In an embodiment of the present disclosure, the conducting layer is a sputtered layer or a screen printed layer. In another embodiment of the present disclosure, the conducting layer is translucent indium tin oxide layer. The one or more electrodes are opaque electrodes such as carbon electrodes and silver electrodes. The EL panel further includes one or more insulating layers between the phosphor layer and the one or more electrodes. The one or more insulating layers are made of insulating materials such as oxides of aluminum, oxides of titanium, oxides of silicon, and oxides of yttrium.

Therefore, it should be clear from the preceding disclosure that the keypad provided in the present disclosure, has a reduced thickness. In addition, actuators on an actuator panel and domes in a dome panel are not necessarily visible when the backlighting module illuminates or even when it does not illuminate the key panel. The keypad also allows changing the key panel and the backlighting module without modifying a printed circuit board because the key panel and the backlighting module do not adhere to the printed circuit board.

Thus, two components that use a polymer film for structure can use the same polymer film. The first side of the polymer film contains a key panel, which can use a polymer film for structure. The second side of the polymer film can contain the backlight panel, which can be entirely printed and/or sputtered and can use a polymer film for structure. Accordingly, both the key panel and the backlighting panel can find their support in the same polymer film.

It is expected that one of ordinary skill, notwithstanding possibly significant effort and many design choices motivated by, for example, available time, current technology, and economic considerations, when guided by the concepts and principles disclosed herein will be readily capable of such keypads with minimal experimentation.

In the foregoing specification, the disclosure and its benefits and advantages have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims. The disclosure is defined solely by the appended claims including any amendments made during the pendency of this application and all equivalents of those claims as issued.

What is claimed is:

1. A keypad for entering data in an electronic device, the keypad comprising:

a first carrier having a first side and a second side;

a key panel coupled to the first side of the first carrier;

a backlighting module coupled to the second side of the first carrier;

an actuator panel located on an opposite side of the backlighting module from the key panel and operatively coupled to the key panel;

a dome panel operatively coupled to the actuator panel through a dome array film; and a printed circuit board coupled to the dome panel.

2. The keypad of claim 1, wherein the first carrier comprises a polymer film and the key panel is coupled to the first side of the first carrier by an adhesive.

3. The keypad of claim 1, wherein the backlighting module is an electroluminescent panel.

4. The keypad of claim 3, wherein the backlighting module comprises:

a conducting layer located on the second side on the first carrier;

a phosphor layer located on the conducting layer; and one or more electrodes coupled to the phosphor layer.

5. The keypad of claim 4, wherein the phosphor layer is a conductor comprising one of a sputtered layer and a screen printed layer.

6. The keypad of claim 4, wherein the conducting layer is a translucent layer made up of indium tin oxide.

7. The keypad of claim 4, wherein the one or more electrodes are opaque electrodes selected from a group comprising carbon electrodes, and silver electrodes.

8. The keypad of claim 4, wherein the backlighting module further comprises one or more insulating layers between the phosphor layer and the one or more electrodes.

9. The keypad of claim 8, wherein the one or more insulating layers are made of material selected from a group comprising oxides of aluminum, oxides of titanium, oxides of silicon, and oxides of yttrium.

10. The keypad of claim 1, wherein the first carrier is a substrate selected from a group comprising polyethylene terephthalate substrate, a polyester substrate, and a polycarbonate substrate.

11. A keypad, comprising:

an electroluminescent panel having a first side and a second side and comprising: a phosphor layer, one or more electrodes coupled to the phosphor layer and one or more insulating layers between the phosphor layer and the one or more electrodes;

a key panel coupled to the first side of the electroluminescent panel; and a dome array coupled to the second side of the electroluminescent panel.

12. The keypad of claim 11, wherein the dome array comprises:

an actuator panel coupled to the second side of the electroluminescent panel and operatively coupled to the key panel; and a dome panel operatively coupled to the actuator panel through a dome array film.

13. The keypad of claim 11, further comprising a printed circuit board coupled to an opposite side of the dome array from the electroluminescent panel.

14. The keypad of claim 11, wherein the phosphor layer is one of a sputtered layer, and a screen printed layer.

15. The keypad of claim 11, wherein the phosphor layer is a translucent layer made up of indium tin oxide.

16. The keypad of claim 11, wherein the one or more electrodes are opaque electrodes selected from a group comprising carbon electrodes and silver electrodes.

17. The keypad of claim 11, wherein the one or more insulating layers are made of material selected from a group comprising oxides of aluminum, oxides of titanium, oxides of silicon, and oxides of yttrium.

* * * * *